US011197351B2

(12) United States Patent
Spitans et al.

(10) Patent No.: US 11,197,351 B2
(45) Date of Patent: Dec. 7, 2021

(54) LEVITATION MELTING METHOD USING MOVABLE INDUCTION UNITS

(71) Applicant: ALD VACUUM TECHNOLOGIES GMBH, Hanau (DE)

(72) Inventors: Sergejs Spitans, Hanau (DE); Henrik Franz, Freigericht-Horbach (DE); Bjoern Sehring, Bessenbach (DE); Egon Bauer, Bessenbach (DE); Andreas Krieger, Frankfurt am Main (DE)

(73) Assignee: ALD VACUUM TECHNOLOGIES GMBH, Hanau (DE)

( * ) Notice: Subject to any disclaimer, the term of this patent is extended or adjusted under 35 U.S.C. 154(b) by 0 days.

(21) Appl. No.: 17/049,526

(22) PCT Filed: Jul. 9, 2019

(86) PCT No.: PCT/EP2019/068430
§ 371 (c)(1),
(2) Date: Oct. 21, 2020

(87) PCT Pub. No.: WO2020/016061
PCT Pub. Date: Jan. 23, 2020

(65) Prior Publication Data

US 2021/0251054 A1 Aug. 12, 2021

(30) Foreign Application Priority Data

Jul. 17, 2018 (DE) ..... 10 2018 117 300.8

(51) Int. Cl.

| | |
|---|---|
| ***H05B 6/32*** | (2006.01) |
| ***H05B 6/24*** | (2006.01) |
| ***H05B 6/36*** | (2006.01) |
| ***H05B 6/44*** | (2006.01) |

(52) U.S. Cl.
CPC ..... *H05B 6/32* (2013.01); *H05B 6/24* (2013.01); *H05B 6/365* (2013.01); *H05B 6/44* (2013.01)

(58) Field of Classification Search
CPC .. B22D 39/003; B22D 13/026; B22D 13/107; B22D 13/12; B22D 21/02; B22D 21/022;
(Continued)

(56) References Cited

U.S. PATENT DOCUMENTS 2,664,496 A * 12/1953 Brace ..... H05B 6/32 219/648
2,686,864 A 8/1954 Wroughton et al.
(Continued)

FOREIGN PATENT DOCUMENTS

DE 422004 C 11/1925
DE 1565467 A1 4/1970
(Continued)

OTHER PUBLICATIONS

English language translation of International Search Report dated Oct. 17, 2019, prepared in International Application No. PCT/EP2019/068430.
(Continued)

*Primary Examiner* — Hung D Nguyen
(74) *Attorney, Agent, or Firm* — Barnes & Thornburg LLP; Ryan L. Marshall

(57) ABSTRACT

The invention relates to a levitation melting process and a device for producing castings with movable induction units. In this process, induction units are used in which the opposite ferrite poles with the induction coils are movable and move in opposite directions. In this way, the induction units for melting the batches can be arranged close together in order to increase the efficiency of the induced magnetic field. When casting the molten batch, the induced magnetic
(Continued)

field is reduced by increasing the distance between the ferrite poles with the induction coils, thus preventing the melt from touching the ferrite poles or the induction coils.

7 Claims, 2 Drawing Sheets

(58) Field of Classification Search
CPC .... B22D 21/025; B22D 27/003; B22D 27/02; B22D 27/15; B22D 5/04; B22D 1/002; H05B 6/24; H05B 6/32; H05B 6/365; H05B 6/44; B23K 26/0006; B23K 26/12; B23K 26/1224; B23K 26/127; B23K 26/1423; B23K 26/354
USPC ..... 219/647, 648, 649
See application file for complete search history.

(56) References Cited

U.S. PATENT DOCUMENTS

| | | | |
|---|---|---|---|
| 3,363,081 | A | 1/1968 | Noiret |
| 4,578,552 | A | 3/1986 | Mortimer |
| 5,033,948 | A | 7/1991 | El-Kaddah et al. |
| 5,837,055 | A | 11/1998 | Yamada et al. |
| 6,144,690 | A | 11/2000 | Kusamichi et al. |
| 9,832,819 | B2 | 11/2017 | Haimer |
| 2015/0041456 | A1 | 2/2015 | Haimer |
| 2019/0366427 | A1 | 12/2019 | Franz et al. |

FOREIGN PATENT DOCUMENTS

| | | |
|---|---|---|
| DE | 69031479 | 10/1997 |
| DE | 69617103 | 1/2002 |
| DE | 69931141 | 6/2006 |
| DE | 102011082611 A1 | 3/2013 |
| DE | 102017100836 A1 | 8/2018 |

OTHER PUBLICATIONS

Tadano, Hideaki et al., "Progress of levitation dissolution system (CCLM)", Fuji Jiho, 1998. Fuji Jiho, 1998, 71(5), pp. 259-263.

* cited by examiner

LEVITATION MELTING METHOD USING MOVABLE INDUCTION UNITS

This application is a National Stage application of International Application No. PCT/EP2019/068430, filed Jul. 9, 2019. This application also claims priority under 35 U.S.C. § 119 to German Patent Application No. 10 2018 117 300.8, filed Jul. 17, 2018.

This invention relates to a levitation melting method and an apparatus for producing cast bodies with movable induction units. In this method, induction units are employed, in which the two opposing ferrite poles with the induction coils are movably arranged and move in opposite directions. In this way, the induction units for melting the batches can be arranged close together in order to increase the efficiency of the induced magnetic field. When casting the molten batch, the induced magnetic field is reduced by increasing the distance between the ferrite poles and the induction coils and thereby preventing the melt from touching the ferrite poles or the induction coils.

STATE OF THE ART

Levitation melting processes are known from the state of the art. DE 422 004 A thus already reveals a melting method in which the conductive material to be melted is heated by inductive currents and at the same time kept levitating by electrodynamic action. A casting method is also described there, in which the molten material is pressed into a mould, conveyed by a magnet (electrodynamic pressed casting). The method can be carried out under vacuum.

U.S. Pat. No. 2,686,864 A also describes a process in which a conductive material to be melt is put into a levitating state e.g. in a vacuum under the influence of one or more coils without the use of a crucible. In one embodiment, two coaxial coils are used to stabilize the material in levitation. After melting, the material is dropped or cast into a mould. The process described there made it possible to keep a 60 g aluminium portion levitating. The removal of the molten metal occurs by reduction of the field strength so that the melt escapes downwards through the conically tapered coil. If the field strength is reduced very quickly, the metal falls out of the apparatus in a molten state. It has already been recognised that the "weak spot" of such coil arrangements is in the centre of the coils so that the amount of material that can be melted this way is limited.

Also U.S. Pat. No. 4,578,552 A reveals an apparatus and a method for levitation melting. The same coil is used for both heating and holding the melt, varying the frequency of the alternating current applied for controlling the heating power while keeping the current constant.

The particular advantages of levitation melting are that it avoids contamination of the melt by a crucible material or other materials that come into contact with the melt during other methods. The reaction of a reactive melt, for example titanium alloys, with the crucible material is also prevented, which would otherwise force to switch from ceramic crucibles to copper crucibles operated in the cold crucible method. The levitating melt is only in contact with the surrounding atmosphere, which can be vacuum or inert gas, for example. As there is no need to fear a chemical reaction with a crucible material, the melt can also be heated to very high temperatures. In contrast to cold crucible melting, there is also no problem that its effectiveness is very low because almost all the energy that is introduced into the melt is diverted into the cooled crucible wall, which leads to a very slow rise in temperature with high power input. In levitation melting, the only losses are due to radiation and evaporation which are considerably lower compared to thermal conduction in the cold crucible. Thus, with a lower power input, a greater overheating of the melt is achieved in an even shorter time.

In addition, the scrap of contaminated material during levitation melting is reduced, especially in comparison to the melt in the cold crucible. Nevertheless, levitation melting has not become established in practice. The reason for this is that in the levitation melting method only a relatively small amount of molten material can be kept in levitation (see DE 696 17 103 T2, page 2, paragraph 1).

Furthermore, for performing a levitation melting method, the Lorentz force of the coil field must compensate for the weight force of the batch in order to keep it levitating. It pushes the batch upwards out of the coil field. For increasing the efficiency of the generated magnetic field, a reduction of the distance between the opposing ferrite poles is aimed at. The distance reduction allows to generate the same magnetic field at lower voltage as is required to hold a predetermined melt weight. In this way, the holding efficiency of the plant can be improved in order to let a larger batch levitate. Furthermore, the heating efficiency is also increased, as the losses in the induction coils are reduced.

The smaller the distance between the ferrite poles, the greater the induced magnetic field. However, the risk of contamination of the ferrite poles and of the induction coils with the melt increases with decreasing distance, since the field strength for the casting must be reduced. This not only reduces the holding force in the vertical direction, but also in the horizontal direction. This results in a horizontal expansion of the levitating melt slightly above the coil field, which makes it extremely difficult to drop it through the narrow gap between the ferrite poles into the casting mould positioned below without touching it. Therefore, increasing the carrying capacity of the coil field by reducing the distance of the ferrite poles is a practical limit determined by the contact probability.

The disadvantages of the methods known from the state of the art can be summarized as follows. Full levitation melting methods can only be carried out with small amounts of material, so that industrial application has not yet occurred. Furthermore, casting in casting moulds is difficult. This is particularly the case if the efficiency of the coil field in the generation of eddy currents is to be increased by reducing the distance between the ferrite poles.

OBJECTIVE

It is therefore an objective of the present invention to provide a method and an apparatus which enable the economic use of levitation melting. In particular, the method should allow the use of larger batches by improving the efficiency of the coil field and should enable a high throughput by shortened cycle times, while ensuring that the casting process occurs safely without the melt coming into contact with the coils or their poles.

DESCRIPTION OF THE INVENTION

The objective is solved by the method according to the invention and the apparatus according to the invention. According to the invention is a method for producing cast bodies from an electrically conductive material by a levitation melting method, wherein alternating electromagnetic fields are employed for causing the levitation state of a batch, said alternating electromagnetic fields being generated with at least one pair of opposing induction coils with a core of a ferromagnetic material, wherein the induction coils with their cores are movably arranged in each pair relative to each other and move between a small distance melting position and a wide distance casting position, comprising the following steps:

Moving the pairs of induction coils to the smelting position at a small distance, introducing a batch of a starting material into the sphere of influence of at least one alternating electromagnetic field so that the batch is kept in a levitating state, melting the batch, positioning a casting mould in a filling area below the levitating batch, casting the entire batch into the casting mould, by moving the induction coils in at least one pair from the melting position at a small distance to the casting position at a wide distance, removal of the solidified cast body from the casting mould.

The volume of the molten batch is preferably sufficient to fill the casting mould to a level sufficient for producing a cast body ("filling volume"). After filling the casting mould, it is allowed to cool or cooled with coolant so that the material solidifies in the mould. The cast body can then be removed from the mould.

A "conductive material" is understood to be a material which has a suitable conductivity in order to inductively heat the material and keeping it in levitation.

A "levitating state" according to the invention is defined as a state of complete levitation so that the treated batch has no contact whatsoever with a crucible or platform or the like.

The term 'ferrite pole' is used synonymously with the term "core of ferromagnetic material" in this application. Likewise, the terms "coil" and "induction coil" are employed synonymously side by side.

By moving the induction coil pairs closer together, the efficiency of the generated alternating electromagnetic field can be increased. This makes it possible to make heavier batches levitate, too. However, when casting a batch, the risk of touching the molten batch with the coils or ferrite poles increases with decreasing free cross-section between the coils. However, such impurities must be strictly avoided, as they are difficult and time-consuming to remove and therefore result in a prolonged downtime of the plant. In order to be able to exploit the advantages of the narrower distance of the pairs of induction coil pairs as far as possible, without having to accept the risk of impurities during casting, the induction coils with their cores are according to the invention movably mounted in at least one pair, respectively. Preferably, the coils of a pair move counter-rotating centrosymmetrically around the center of the induction coil arrangement.

To melt the batch, the coils are pushed together into the melting position. Once the batch has melted and is to be cast into the casting mould, the coils are not simply switched off or the current is reduced, as is customary in the state of the art, but, in accordance with the invention, are moved outwards into a casting position. This increases the distance between the coils, which on the one hand creates a larger free diameter for the melt on its way into the casting mould and on the other hand reduces the carrying capacity of the induced magnetic field continuously and in a controlled manner. In this way, the melt is held safely away from the induction coils and their cores as it passes through the coil plane and only slowly passes into the fall, because the field is already weakened in the center, but is still strong enough at the coils to prevent contact. This prevents contamination of the coils as well as ensures clean casting into the casting mould without spraying.

In a preferred design variant of the invention, during casting of the batch, simultaneously with the movement of the induction coils in the pairs of induction coils from the melting position to the casting position, the current intensity in these induction coils is reduced. This makes it possible to realize a reduction of the required displacement path of the induction coils, since the induced magnetic field is no longer only reduced by the greater distance between the inducing coils. However, it must be ensured that the reduction of the current intensity is coordinated with the displacement of the coils such that the field strength is always sufficiently high to keep the melt away from the coils.

In one embodiment, the distance of the induction coils in the pairs of induction coils is increased from the melting position to the casting position by 5-100 mm, preferably 10-50 mm. When determining the displacement path, the batch weights for which the system is to be designed and the minimum distance between the coils and the field strength that can be generated with them must be taken into account.

The electrically conductive material used in accordance with the invention has in a preferred embodiment at least one high-melting metal from the following group: titanium, zirconium, vanadium, tantalum, tungsten, hafnium, niobium, rhenium, molybdenum. Alternatively, a less high-melting metal such as nickel, iron or aluminium can also be employed. A mixture or alloy with one or more of the above metals can also be employed as a conductive material. Preferably the metal has a proportion of at least 50% by weight, in particular at least 60% by weight or at least 70% by weight, of the conductive material. It has been shown that these metals particularly benefit from the advantages of the present invention. In a particularly preferred embodiment, the conductive material is titanium or a titanium alloy, in particular TiAl or TiAlV.

These metals or alloys can be processed in a particularly advantageous way, as they have a pronounced dependence of viscosity on temperature and are also particularly reactive, especially with regard to the materials of the casting mould. Since the method according to the invention combines contactless melting in levitation with extremely fast filling of the casting mould, a particular advantage can be realized for such metals. The method according to the invention can be used to produce cast bodies which exhibit a particularly thin or even no oxide layer at all from the reaction of the melt with the material of the casting mould. And especially in the case of high-melting metals, the improved utilization of the induced eddy current and the exorbitant reduction of heat losses due to thermal contact are noticeable with regard to the cycle times. Furthermore, the carrying capacity of the generated magnetic field can be increased so that heavier batches can also be kept in levitation.

In an advantageous embodiment of the invention, the conductive material is superheated during melting to a temperature which is at least 10° C., at least 20° C. or at least 30° C. above the melting point of the material. Overheating prevents the material from solidifying instantly on contact with the casting mould, whose temperature is below the melting temperature. It is achieved that the batch can distribute in the casting mould before the viscosity of the material becomes too high. An advantage of levitation melting is that no crucible has to be used which is in contact with the melt. This avoids the high material loss of the cold crucible process on the crucible wall as well as contamination of the melt by crucible components. A further advantage is that the melt can be heated to a relatively high temperature, since operation in vacuum or under protective gas is possible and there is no contact with reactive materials. Nevertheless, most materials cannot be overheated arbitrarily, as otherwise a violent reaction with the casting mould is to be feared. Therefore, overheating is preferably limited to a maximum of 300° C., in particular to a maximum of 200° C. and particularly preferably to a maximum of 100° C. above the melting point of the conductive material.

In the method, at least one ferromagnetic element is arranged horizontally around the area in which the batch is melted in order to concentrate the magnetic field and to stabilize the batch. The ferromagnetic element can be arranged ring-shaped around the melting area, wherein "ring-shaped" means not only circular elements, but also angular, in particular square or polygonal ring elements. In order to enable the movement of the induction coils in accordance with the invention, the ring elements are divided into sub-segments according to the number of coils, between which the respective induction coils with their poles move in a form-fitting manner. The ferromagnetic element may also have several bar sections which protrude in particular horizontally in the direction of the melting area. The ferromagnetic element consists of a ferromagnetic material, preferably with an amplitude permeability $\mu_a>10$, more preferably $\mu_a>50$ and particularly preferably $\mu_a>100$. Amplitude permeability refers in particular to permeability in a temperature range between 25° C. and 150° C. and at a magnetic flux density between 0 and 500 mT. The amplitude permeability amounts in particular at least one hundredth, and in particular at least 10 hundredth or 25 hundredth, of the amplitude permeability of soft magnetic ferrite (e.g. 3C92). The person skilled in the art knows suitable materials.

According to the invention, there is also an apparatus for levitation melting an electrically conductive material, comprising at least one pair of opposing induction coils with a core of a ferromagnetic material for causing the levitation state of a batch by means of alternating electromagnetic fields, wherein the induction coils with their cores are in each pair movably arranged and move between a melting position at a small distance and a casting position at a wide distance.

DESCRIPTION OF THE FIGURES

The figures show preferred embodiments. They are for illustrative purposes only.

Figure 1:
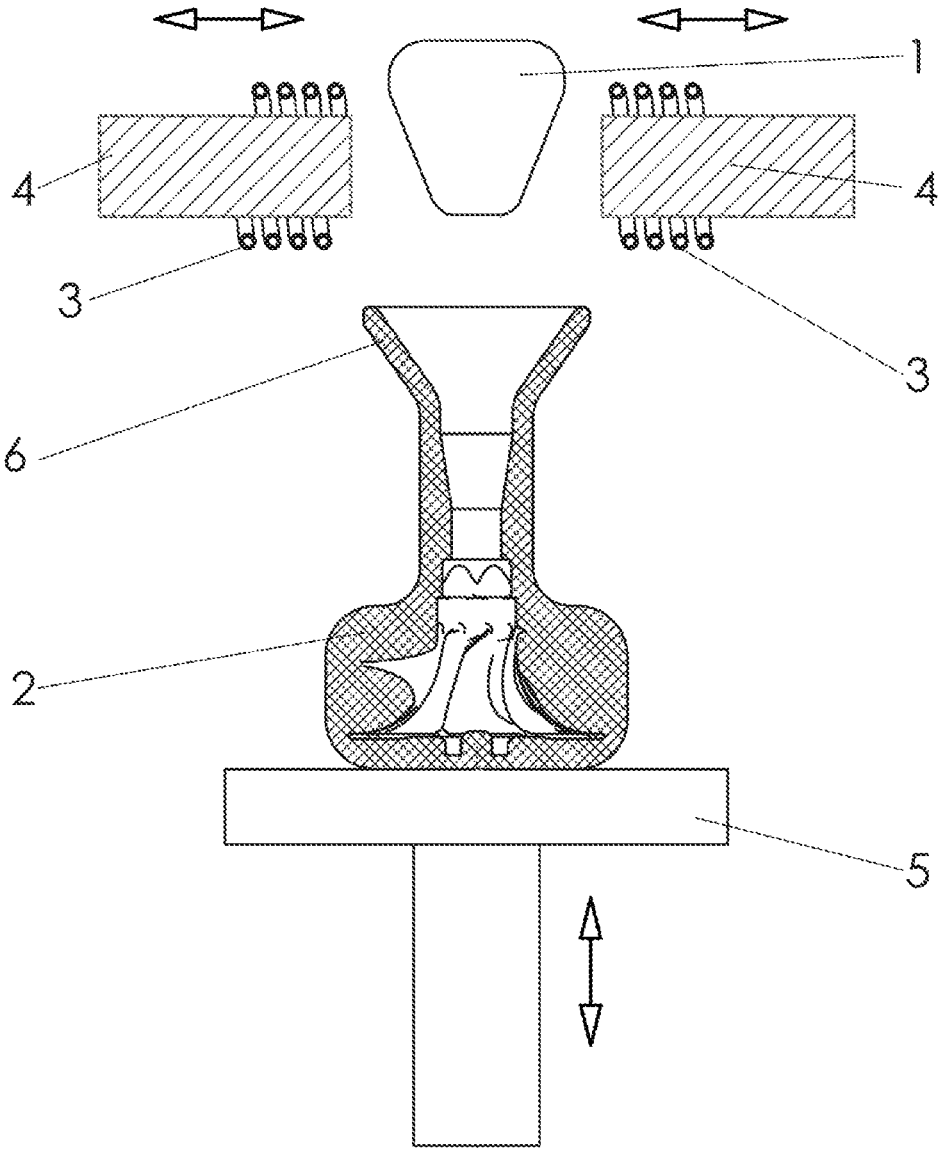
FIG. 1 is a lateral cross-sectional view of a casting mould below a melting area with ferromagnetic material, coils and a batch of conductive material.

FIG. 1 shows a batch (1) of conductive material which is in the influence area of alternating electromagnetic fields (melting area) generated by the coils (3). Below the batch (1) there is an empty casting mould (2) which is held in the filling area by a holder (5). The casting mould (2) has a funnel-shaped filling section (6). The holder (5) is suitable for lifting the casting mould (2) from a feeding position to a casting position, which is symbolized by the drawn arrow. A ferromagnetic material (4) is arranged in the core of the coils (3). The axes of the pair of coils (3) are horizontally aligned, wherein each two opposing coils (3) are forming a pair. In the figure the melting position of the coil arrangement at a short distance.

The batch (1) is melted while levitating in the process according to the invention and cast into the casting mould (2) after the melt has occurred. For casting, the coils (3), as symbolised by the drawn arrow, are separated from each other until the Lorentz force of the field can no longer compensate the weight force of the batch (1).

Figure 2:
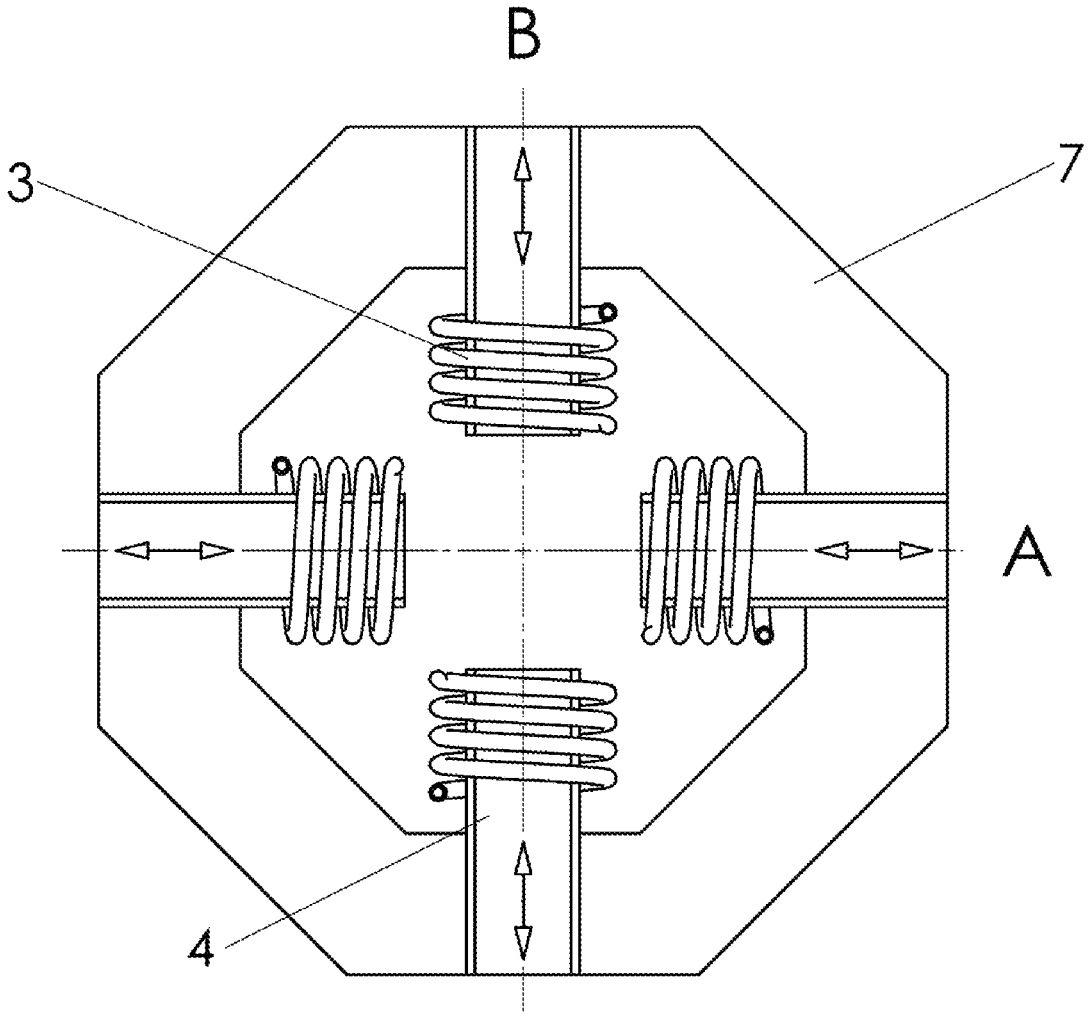
FIG. 2 is a top view on an arrangement with two coil pairs and a ferromagnetic element.

FIG. 2 shows a plan view of an arrangement with two pairs of coils and a ferromagnetic ring-shaped element (7). The ring-shaped element (7) is designed as an octagonal ring element. Each two coils (3) lying on an axis A, B with their ferromagnetic material (4) form a pair of coils. The coil axes A, B are arranged at right angles to each other. The figure shows the melting position of the coil arrangement with narrow distances between the coils (3). The ferromagnetic materials (4), which are positively seated in the ring-shaped element (7), then move together with their coils (3), as indicated by the double arrows, outwards for the casting the levitating melt.

LIST OF REFERENCE NUMERALS

1 batch
2 casting mould
3 induction coil
4 ferromagnetic material
5 holder
6 filling section
7 ring-shaped element

The invention claimed is:

1. A method for producing cast bodies from an electrically conductive material by a levitation melting method, wherein alternating electromagnetic fields levitate a batch, the alternating electromagnetic fields being generated with at least one pair of opposing induction coils with a core of a ferromagnetic material, wherein the induction coils with their cores are movably arranged in each pair relative to each other and move between a small distance melting position and a wide distance casting position, comprising:

moving the pairs of induction coils with their cores to the smelting position at a small distance;

introducing a batch of a starting material into a sphere of influence of at least one alternating electromagnetic field so that the batch is kept in a levitating state;

melting the batch;

positioning a casting mold in a filling area below the levitating batch;

casting the entire batch into the casting mold by moving the induction coils with their cores in at least one pair from the melting position at a small distance to the casting position at a wide distance;

removing a solidified cast body from the casting mold.

2. The method according to claim 1, wherein during the casting of the batch simultaneously with the movement of the induction coils in the pairs of induction coils from the melting position to the casting position, the current intensity in these induction coils is reduced.

3. The method according to claim 1, wherein the distance of the induction coils in the pairs of induction coil is increased from the melting position to the casting position by 5-100 mm.

4. The method according to claim 1, wherein the distance of the induction coils in the pairs of induction coil is increased from the melting position to the casting position by 10-50 mm.

5. An apparatus for levitation melting an electrically conductive material, comprising at least one pair of opposing induction coils with a core of a ferromagnetic material for levitating a batch by means of alternating electromagnetic fields, wherein the induction coils with their cores are movably arranged in each pair relative to each other and move between a small distance melting position and a wide distance casting position.

6. The apparatus according to claim 5, wherein the distance of the induction coils in the pairs of induction coils is increased from the melting position to the casting position by 5-100 mm.

7. The apparatus according to claim 5, wherein the distance of the induction coils in the pairs of induction coils is increased from the melting position to the casting position by 10-50 mm.

* * * * *